US011624374B2

(12) United States Patent
Marques et al.

(10) Patent No.: US 11,624,374 B2
(45) Date of Patent: Apr. 11, 2023

(54) BOOSTER FAN

(71) Applicants: Al Marques, Swift Current (CA); James Braun, Herbert (CA)

(72) Inventors: Al Marques, Swift Current (CA); James Braun, Herbert (CA)

(73) Assignee: S3 Group Ltd., Calgary (CA)

( * ) Notice: Subject to any disclaimer, the term of this patent is extended or adjusted under 35 U.S.C. 154(b) by 0 days.

(21) Appl. No.: 17/542,003

(22) Filed: Dec. 3, 2021

(65) Prior Publication Data

US 2022/0178387 A1 Jun. 9, 2022

(30) Foreign Application Priority Data

Dec. 4, 2020 (CA) ..... CA 3101646

(51) Int. Cl.
*F04D 29/64* (2006.01)
*F04D 19/00* (2006.01)

(52) U.S. Cl.
CPC ..... *F04D 29/646* (2013.01); *F04D 19/002* (2013.01)

(58) Field of Classification Search
CPC ..... F04D 29/646; F04D 19/002; F04D 29/541
See application file for complete search history.

(56) References Cited

U.S. PATENT DOCUMENTS 2,011,421 A * 8/1935 Searles ..... F24D 5/02 415/129
2,782,991 A * 2/1957 Allen ..... F24H 9/2064 415/19
4,250,632 A * 2/1981 Botkins ..... F26B 17/122 34/174
2002/0006774 A1* 1/2002 Kilburn ..... F24F 7/00 454/341
2020/0018334 A1* 1/2020 Le Mon ..... B25B 5/08
2022/0010806 A1* 1/2022 Purdey ..... F04D 29/164

FOREIGN PATENT DOCUMENTS

CN 202228399 U * 5/2012

* cited by examiner

*Primary Examiner* — Aaron R Eastman
(74) *Attorney, Agent, or Firm* — Thompson Hine LLP

(57) ABSTRACT

A fan including a housing having an air inlet and an air outlet. An impeller is disposed in the housing and driven by a motor connected thereto. A connecting mechanism is disposed on the housing in proximity to the outlet. The connecting mechanism is adapted for being mated with a respective connecting structure.

11 Claims, 6 Drawing Sheets

BOOSTER FAN

This application claims priority to Canadian Patent Application No. 3,101,646 filed on Dec. 4, 2020 and entitled BOOSTER FAN, and the entire contents which are incorporated by reference herein.

FIELD

The present disclosure relates to aeration fans, and more particularly to a booster fan that is easily attached to and removed from an existing fan.

BACKGROUND

Harvested grain such as, for example, wheat, rye, barley, canola, soybeans, and corn, is typically stored in storage bins—on site at a farm or commercial storage facilities—prior to distribution for processing or sale. Present-day agricultural storage bins are not only used for storing the grains therein, but also for assisting in drying, cooling, heating, and pest control by employing aeration thereto. Aeration fans supply air flow to the agricultural storage bins for drying, cooling, heating, and pest control.

Depending on the type of grain, the fill level of the agricultural storage bin, and the task to be performed such as drying, cooling, heating, and pest control different rates of air flow and air pressure are required. Providing the agricultural storage bin with one or more aeration fans that provide sufficient rates of air flow and air pressure for performing all tasks is cost intensive and results in the aeration fans being under-utilized most of the time.

While it may be known in other industries to connect two or more fans in series to increase air pressure for a given application it is, typically, a difficult and time consuming task to connect the fans and is mostly done only once during installation.

It may be desirable to provide a booster fan that is quickly and easily attached to and removed from an existing fan.

It also may be desirable to provide a booster fan that is easy to handle.

It also may be desirable to provide a booster fan that is efficient and easy to manufacture.

SUMMARY

Accordingly, in one case the present disclosure provides a booster fan that is quickly and easily attached to and removed from an existing fan.

The present disclosure can also provide a booster fan that is easy to handle.

The present disclosure can provide a booster fan that is efficient and easy to manufacture.

According to one aspect of the present disclosure, there is provided a fan. The fan comprises a housing having an air inlet and an air outlet. An impeller is disposed in the housing and driven by a motor connected thereto. A connecting mechanism is disposed on the housing in proximity to the outlet. The connecting mechanism is adapted for being mated with a respective connecting structure.

According to the aspect of the present disclosure, there is provided a fan. The fan comprises a housing having an air inlet and an air outlet. An impeller is disposed in the housing and driven by a motor connected thereto. A connecting mechanism is disposed on the housing in proximity to the outlet. The connecting mechanism is adapted for being mated with a respective connecting structure. The connecting mechanism comprises at least a hook disposed in proximity to a top of the housing. The at least a hook is adapted for interacting with the connecting structure and for holding the fan in place with respect to the connecting structure. The connecting mechanism further comprises at least a clamping device for interacting with the connecting structure and for securing the fan to the connecting structure.

According to the aspect of the present disclosure, there is provided a fan. The fan comprises a housing having an air inlet and an air outlet. An impeller is disposed in the housing and driven by a motor connected thereto. A connecting mechanism is disposed on the housing in proximity to the outlet. The connecting mechanism is adapted for being mated with a respective connecting structure. The connecting mechanism comprises at least a hook disposed in proximity to a top of the housing. The at least a hook is adapted for interacting with the connecting structure and for holding the fan in place with respect to the connecting structure. The connecting mechanism further comprises at least a clamping device for interacting with the connecting structure and for securing the fan to the connecting structure. A lift lug is disposed on a top of the housing. The lift lug is placed such the fan is oriented substantially horizontally during lifting.

According to another aspect of the present disclosure, there is provided a fan. The fan comprises a housing having an air inlet and an air outlet. An impeller is disposed in the housing and driven by a motor connected thereto. A connecting mechanism is disposed on the housing in proximity to the outlet. The connecting mechanism is adapted for being mated with a respective connecting structure. The housing comprises a single wall surrounding the channel and has an octagonal cross-section.

According to yet another aspect of the disclosure, there is provided a fan. The fan comprises a housing having an air inlet and an air outlet. An impeller is disposed in the housing and driven by a motor connected thereto. A connecting mechanism is disposed on the housing in proximity to the outlet. The connecting mechanism is adapted for being mated with a respective connecting structure. An inside surface of the housing forms a channel between the air inlet and the air outlet such that the channel is tapered towards the outlet.

An advantage of the present disclosure is that it provides a booster fan that is quickly and easily attached to and removed from an existing fan.

A further advantage is that it provides a booster fan that is easy to handle.

A further advantage is that it provides a booster fan that is efficient and easy to manufacture.

BRIEF DESCRIPTION OF THE DRAWINGS

An embodiment is described below with reference to the accompanying drawings, in which.

DETAILED DESCRIPTION

Figure 1:
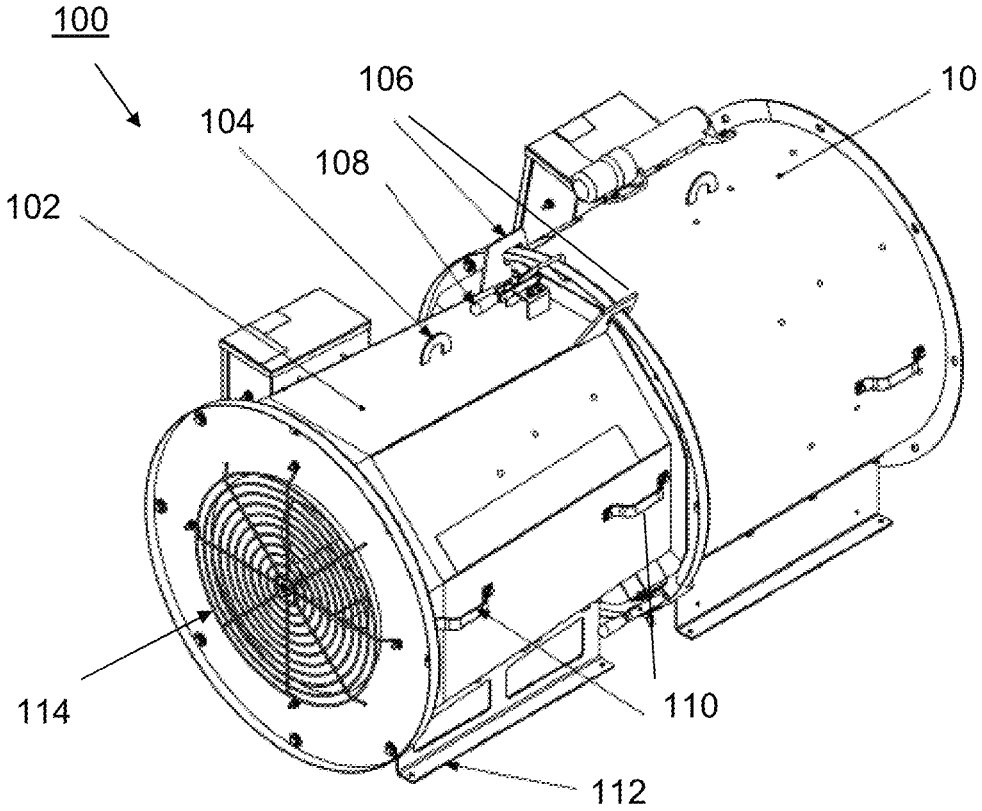
FIGS. 1 and 2 are simplified block diagrams illustrating in a perspective top view and a side view, respectively, a booster fan according to an embodiment with the booster fan being connected to an existing fan.
Figure 2:
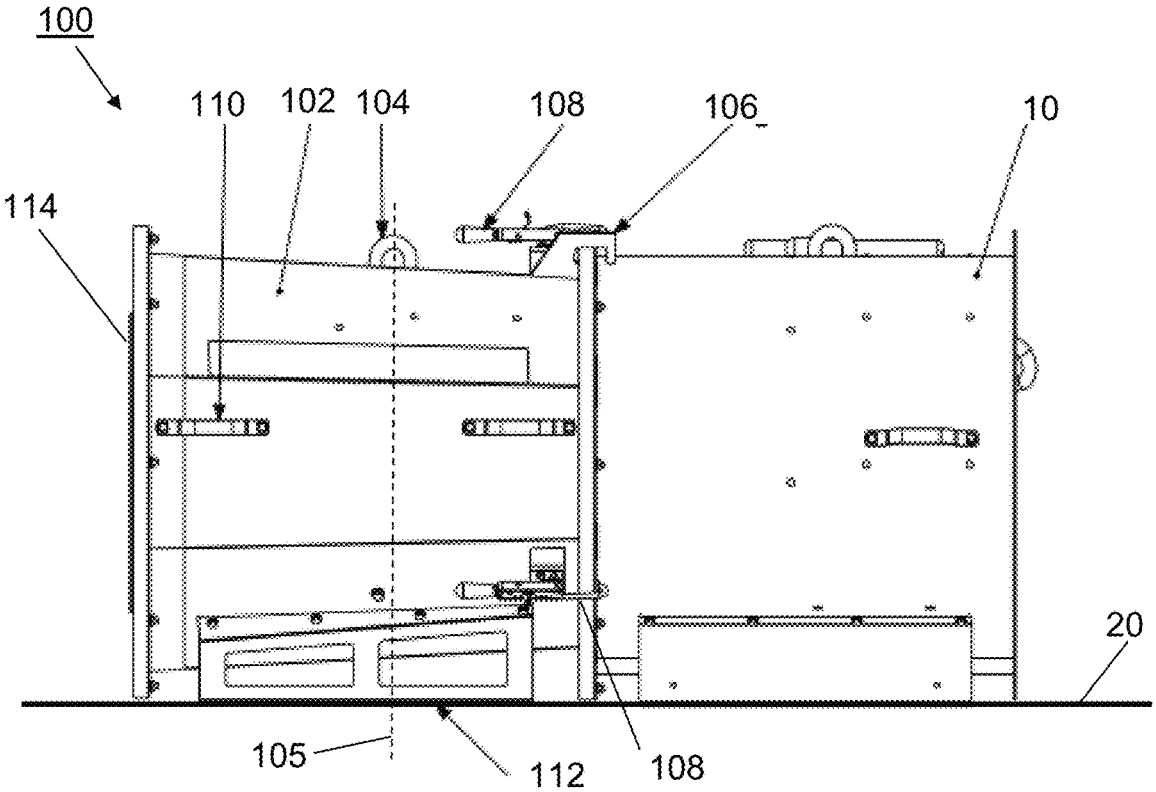
Figure 3:
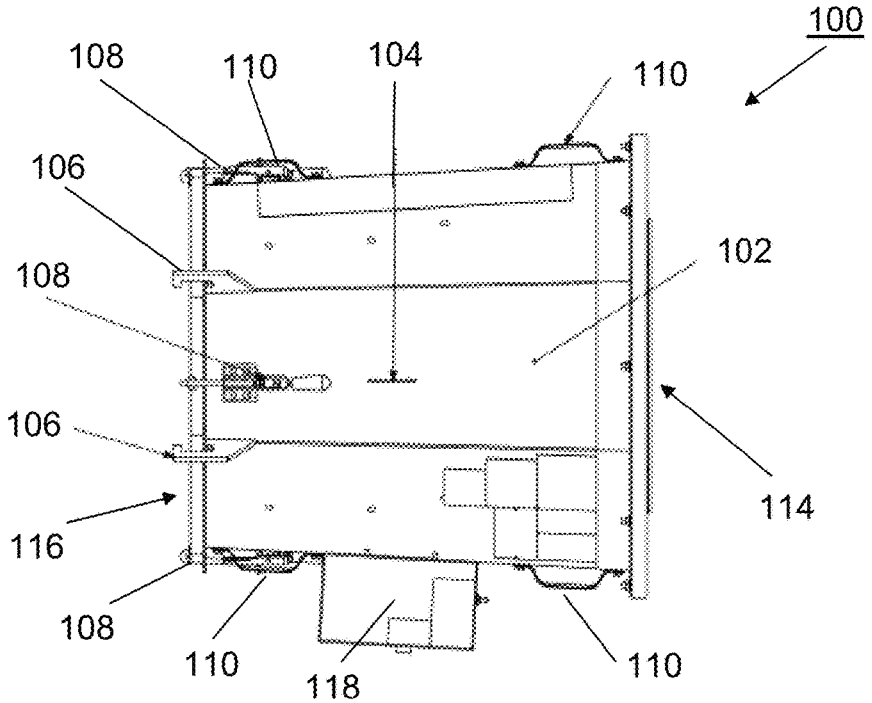
FIG. 3 is a simplified block diagram illustrating in a top view the booster fan according to an embodiment.
Figure 4:
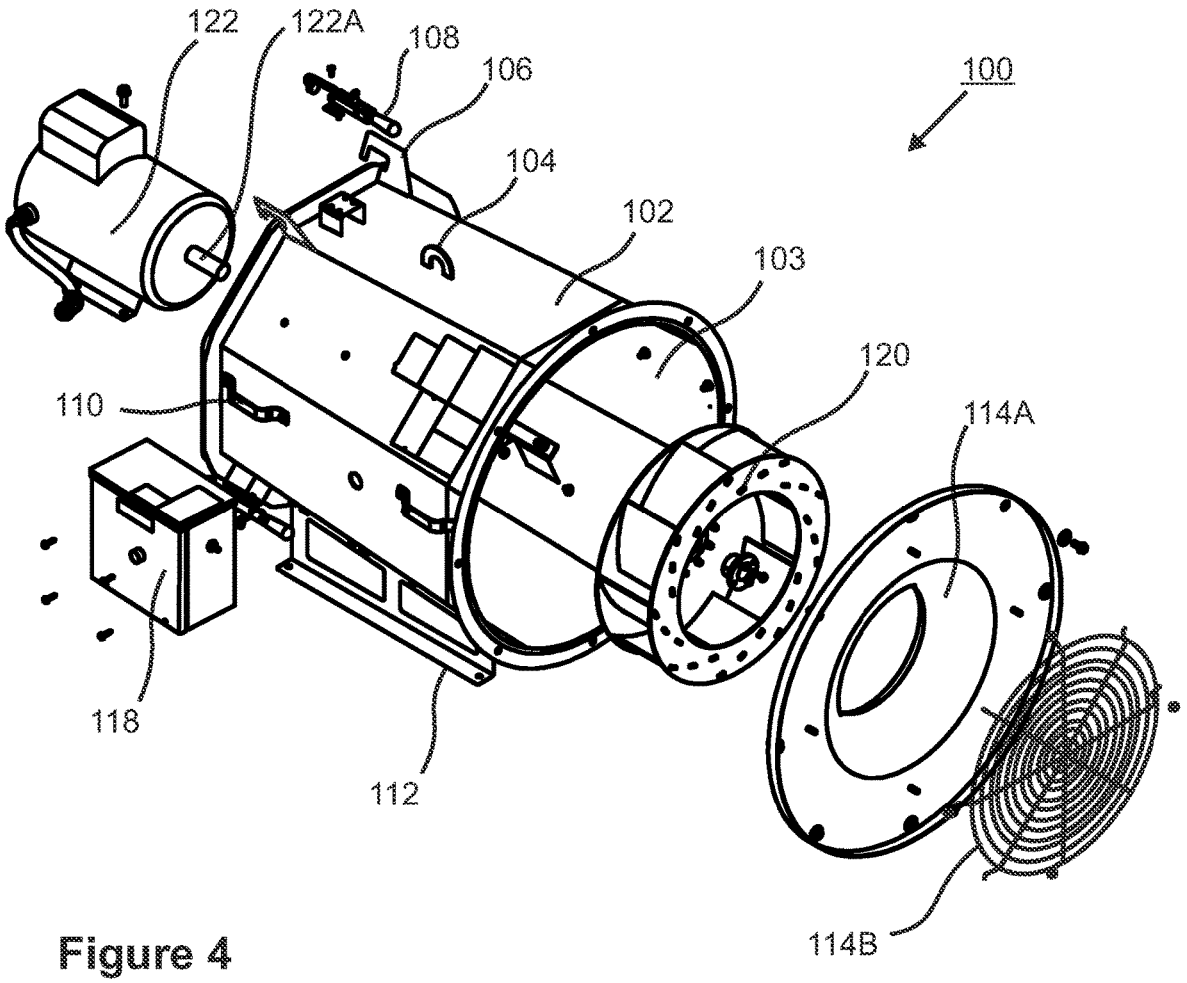
FIG. 4 is a simplified block diagram illustrating in an exploded view the booster fan according to an embodiment.
Figure 5:
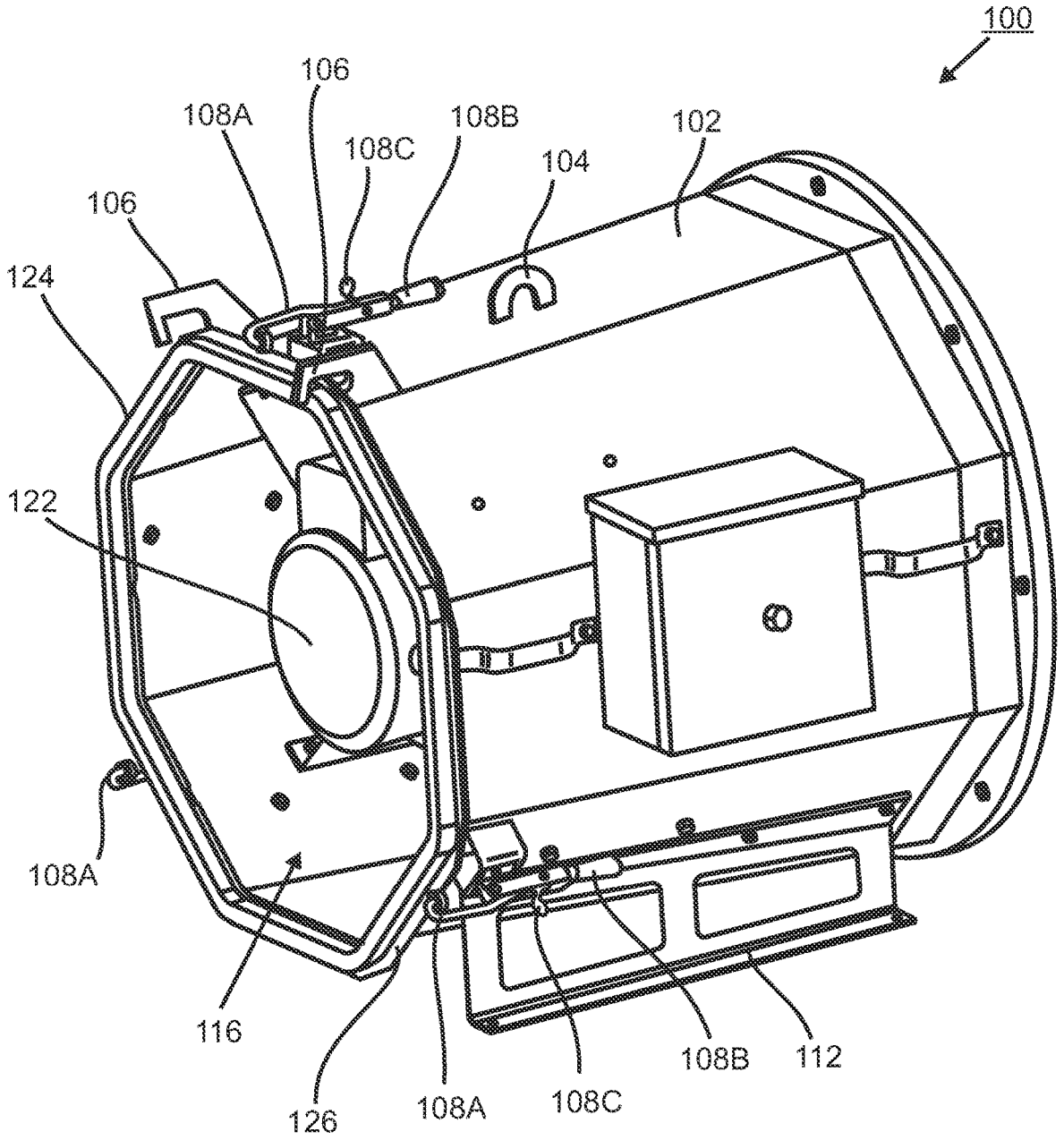
FIG. 5 is a simplified block diagram illustrating in a side perspective view the booster fan according to an embodiment; and, FIGS. 6 and 7 are simplified block diagrams illustrating in a top perspective view and a side perspective view, respectively, a clamping device of the booster fan according to an embodiment.

Unless defined otherwise, all technical and scientific terms used herein have the same meaning as commonly understood by one of ordinary skill in the art to which the invention belongs. Although any methods and materials similar or equivalent to those described herein can be used in the practice or testing of the present invention, certain methods and materials are now described.

While the description of the embodiments hereinbelow is with reference to aeration of an agricultural storage bin, it will become evident to those skilled in the art that the embodiments of the invention are not limited thereto, but are also adaptable for connecting a booster fan to an existing fan in other applications, as well as for use as a standalone fan by mounting the same to a respective connecting structure.

Referring to FIGS. 1 to 7 a booster fan 100 according to an embodiment of the invention is provided. The booster fan 100 comprises housing 102 having air inlet 114 at a first end thereof for receiving air, for example, ambient air, and air outlet 116 at a second opposite end thereof for providing an airstream to the existing fan 10. Impeller 120 is disposed in the housing. The impeller 120 receives the air from the air inlet 114 via inlet shroud 114A and propels the same for providing an airstream to the existing fan 10 connected to the air outlet 116. The impeller is driven by motor 122. The motor 122 can be disposed in the housing 102 with the impeller 120 mounted to shaft 122A. The air inlet 114 is, in one case, covered with protective grid 114B to prevent larger particles or debris from entering the air inlet 114 that may damage the impeller 120. Operation of the fan is controlled via control unit 118 mounted to the housing 102 and connected to the motor 122. Connecting mechanism 106, 108, 126 is disposed on the housing 102 in proximity to the outlet 116. The connecting mechanism 106, 108, 126 is adapted for being mated with respective connecting structure 10A of the existing fan 10.

The connecting mechanism can comprises, for example, two, hooks 106 mounted to the housing 102 in proximity to a top thereof. The hooks 106 are adapted for interacting with the connecting flange 10A of the existing fan 10 for temporarily holding the booster fan 100 in place with respect to the connecting flange 10A of the existing fan 10.

Figure 6:
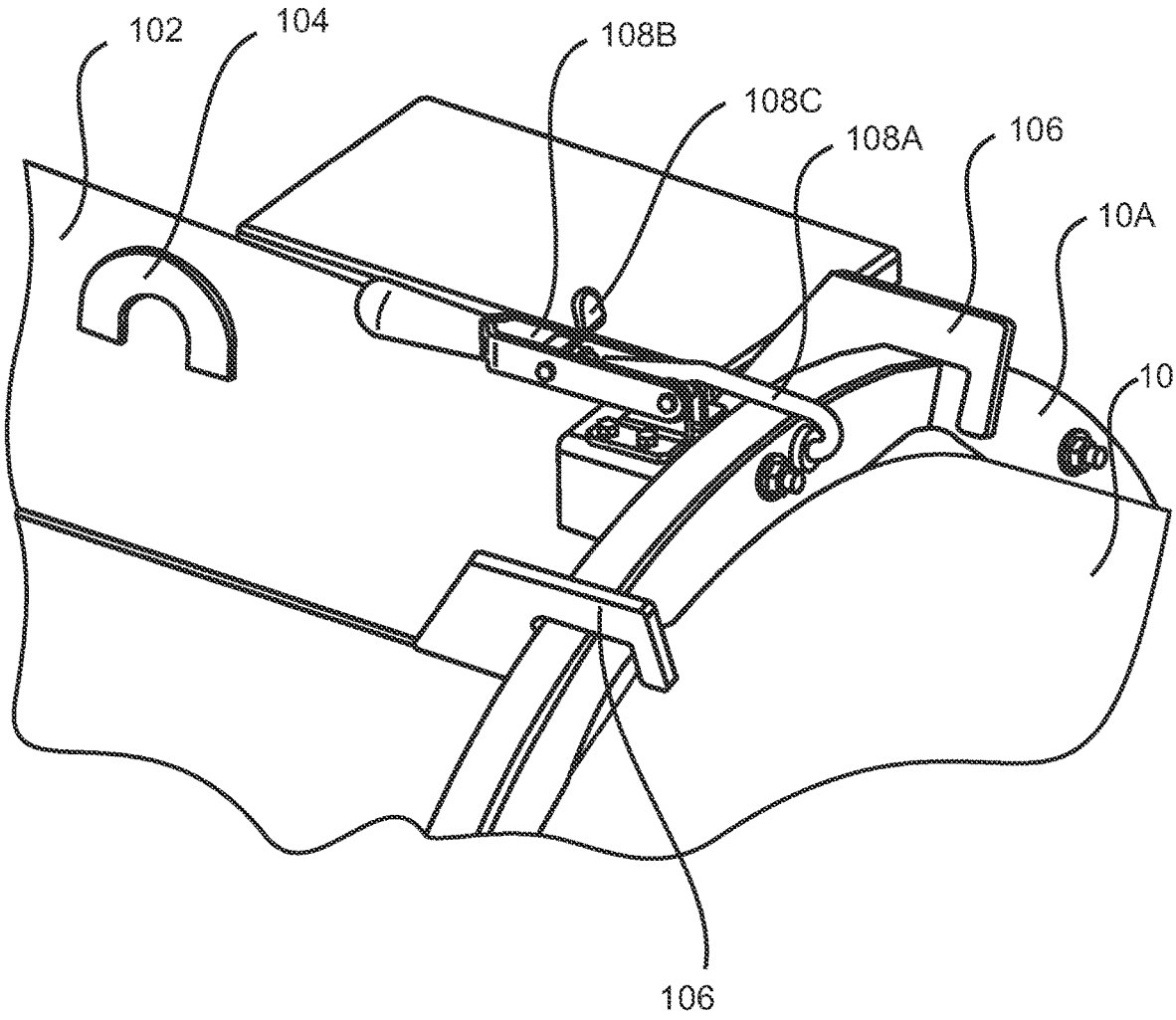
Figure 7:
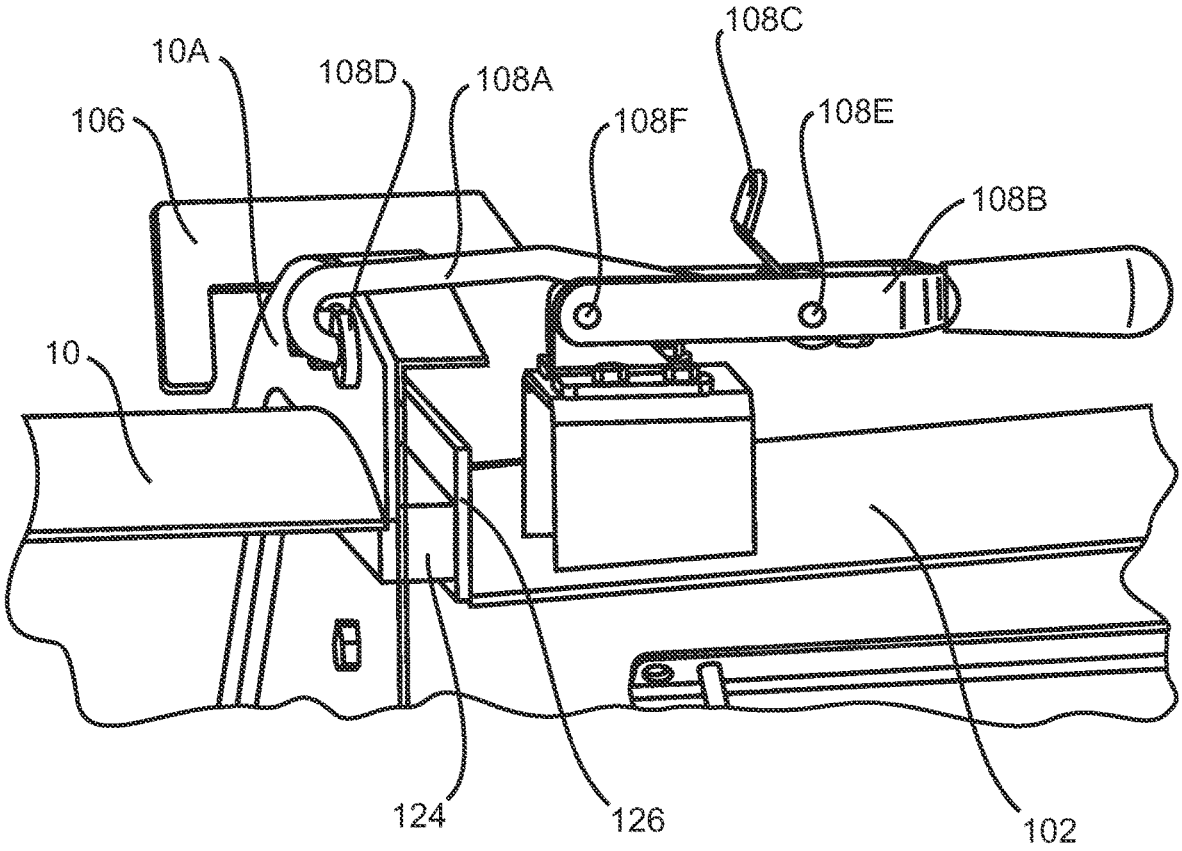

The booster fan 100 is secured to the connecting flange 10A of the existing fan 10 using clamping devices 108, for example, three clamping devices 108 placed in a substantially equidistant manner around the outlet 116. The clamping devices 108 can each comprise clamping arm 108A pivotally movable mounted to clamping lever 108B at pivot 108E. The clamping lever 108B is pivotally movable mounted to the housing 102 at pivot 108F. The clamping device is secured via lock/release lever 108C, which locks the clamping arm 108A in the clamping position with clamping foot 108D interacting with the connecting flange 10A using, for example, a cam mechanism. The clamping device 108 enables quick and easy attachment of the booster fan 100 by simply rotating the clamping lever 108B about the pivot 108F until the same is in a substantially horizontal position, as illustrated in FIGS. 6 and 7, and securing the same via the lock/release lever 108C. For removing the booster fan 100 from the existing fan 10 the same operation is simply performed in reverse. Alternatively, other clamping devices such as, for example, screw type clamping devices, may be employed.

Seal 124 can be disposed on air outlet flange 126 surrounding the air outlet 116 for preventing air leakage between the booster fan 100 and the existing fan 10. The seal 124 is, for example, a rubber seal having a square or rectangular cross-section of relatively large size for facilitating the connecting of the booster fan 100 to the existing fan 10. The seal 124 is mounted to the air outlet flange 126 in a conventional manner using, for example, an adhesive.

The booster fan 100 can comprise lift lug 104 mounted to the top of the housing 102. The lift lug 104 is placed on vertical line 105 through the centre of gravity of the booster fan 100, resulting in a substantially horizontal orientation of the booster fan 100 during lifting operation via the lift lug 104. The lift lug 104, in concert with handles 110, substantially facilitates moving and lifting into place of the booster fan 100.

For attaching, the booster fan 100 is, while being suspended via lift lug 104, moved towards the connecting flange 10A of the existing fan 10 until the hooks 106 are in contact with the flange 10A. The hooks 106, when interacting with connecting flange 10A, hold the booster fan 100 temporarily in place until the seal 124 is in contact with the connecting flange 10A and base 112 of the booster fan 100 is in contact with a support platform 20 after final positioning. The booster fan 100 is then secured to the connecting flange via the clamping devices 108 as described hereinabove. Alternatively, the booster fan 100 remains suspended via lift lug 104 in case there is no suitable support platform or floor available.

The housing 102 can be designed such that an inside surface 103 thereof forms a channel between the air inlet 114 and the air outlet 116 with a cross-section that tapers towards the air outlet 116. The tapering of the channel increases efficiency of the booster fan 100.

The housing 102 can comprise a single wall surrounding the channel with substantially flat wall segments forming an octagonal cross-section. Using a single wall structure having substantially flat wall segments for the housing 102 substantially reduces weight and manufacturing costs by enabling use of pieces of flat sheet material such as, for example, steel sheet material, that are welded together to form the housing 102. Alternatively, the housing 102 may be provided having a different cross-section such as, for example, a circular cross-section.

Various components of the booster fan 100 such as the housing 102, the flange 126, the air inlet shroud 114A, the hooks 106, the clamping devices 108, and the base 112 are made of, for example, steel and steel sheet material, in a conventional manner using, for example, cutting, bending, welding, and screw fastening.

The design of the booster fan 100 minimizes the number of parts and the amount of material, resulting in reduced weight of the same making it easier to move and handle.

The present invention has been described herein with regard to certain embodiments. However, it will be obvious to persons skilled in the art that a number of variations and modifications can be made without departing from the scope of the invention as described herein.

What is claimed is:

1. A fan comprising:

a housing having an air inlet and an air outlet;

an impeller disposed in the housing;

a motor connected to the impeller for driving the same;

an air outlet flange surrounding the air outlet, the air outlet flange for being mated with a respective connecting flange;

a compressible seal mounted to the air outlet flange, the seal for being compressed between the air outlet flange and the respective connecting flange; and, at least a hook mounted to the housing in proximity to the air outlet flange, the at least a hook for interacting with the connecting flange and for temporarily holding the fan in place with respect to the connecting flange.

2. The fan according to claim 1 comprising a lift lug disposed on a top of the housing, the lift lug being placed such that the fan is oriented substantially horizontally during lifting.

3. The fan according to claim 1 wherein an inside surface of the housing forms a channel between the air inlet and the air outlet such that the channel is tapered towards the outlet.

4. The fan according to claim 3 wherein the housing comprises a single wall surrounding the channel.

5. The fan according to claim 1 wherein the housing forms a channel between the air inlet and the air outlet such that the channel has an octagonal cross-section.

6. The fan according to claim 1 comprising a plurality of clamping devices mounted to the housing in proximity to the air outlet flange, the clamping devices being movable between an open position and a clamping position for clamping the air outlet flange to the connecting flange, the clamping devices being fixedly mounted to the housing when in the open position.

7. The fan according to claim 6 wherein each clamping device comprises:

a clamping arm adapted for interacting with the connecting flange; and, a clamping lever pivotally movable mounted to the housing, the clamping lever having the clamping arm pivotally mounted thereto.

8. The fan according to claim 1 wherein the seal is made of a rubber material.

9. A booster fan assembly for boosting an airflow to an agricultural storage bin comprising:

a first fan connected to the agricultural storage bin for providing an airflow to the agricultural storage bin; and, a booster fan comprising an air outlet flange surrounding an air outlet thereof, the air outlet flange being mated with a respective connecting flange surrounding an air inlet of the first fan, the air outlet flange being mated with the connecting flange having a compressible seal compressed therebetween, the booster fan for boosting the air flow provided to the agricultural storage bin by providing a booster air flow to the air inlet of the first fan.

10. The booster fan assembly according to claim 9 wherein the booster fan comprises a clamping mechanism for connecting the same to the first fan.

11. The booster fan assembly according to claim 9 wherein the seal is made of a rubber material.

* * * * *